United States Patent [19]

Pierce et al.

[11] 4,068,889

[45] Jan. 17, 1978

[54] PORTABLE BACK REST

[75] Inventors: James E. Pierce; Max E. Goodwin, both of Valencia, Calif.

[73] Assignee: Marcy Gymnasium Equipment Co., Glendale, Calif.

[21] Appl. No.: 677,927

[22] Filed: Apr. 19, 1976

[51] Int. Cl.[2] ..... A47C 1/16

[52] U.S. Cl. ..... 297/352; 16/150; 16/DIG. 13

[58] Field of Search ..... 297/252, 350, 352, 443, 297/460; 248/174, 250, 300; 211/43, 73, 184; 16/150, DIG. 13

[56] References Cited

U.S. PATENT DOCUMENTS

| | | | |
|---|---|---|---|
| 2,710,646 | 6/1955 | Kirby | 297/350 |
| 2,797,740 | 7/1957 | Cappello | 297/443 X |
| 3,066,980 | 12/1962 | Clute | 297/352 X |
| 3,359,036 | 12/1967 | Druth et al. | 297/352 |
| 3,669,496 | 6/1972 | Chisholm | 297/DIG. 2 X |
| 3,744,601 | 7/1973 | Doppelt | 16/150 X |

FOREIGN PATENT DOCUMENTS

| | | | |
|---|---|---|---|
| 1,401,394 | 4/1965 | France | 16/150 |

*Primary Examiner*—Roy D. Frazier
*Assistant Examiner*—William E. Lyddane
*Attorney, Agent, or Firm*—James E. Brunton

[57] ABSTRACT

A portable back rest adapted to be detachably mounted onto stadium bleacher seats and the like. The back rest is formed of a single piece of flexible material and comprises a back panel, a pair of side panels hingeably connected thereto, and front and rear locking elements adapted to securely grip the bleacher seat. In its transport configuration, the side panels fold inwardly into close proximity with the back panel, thereby forming a compact readily portable unit.

2 Claims, 9 Drawing Figures

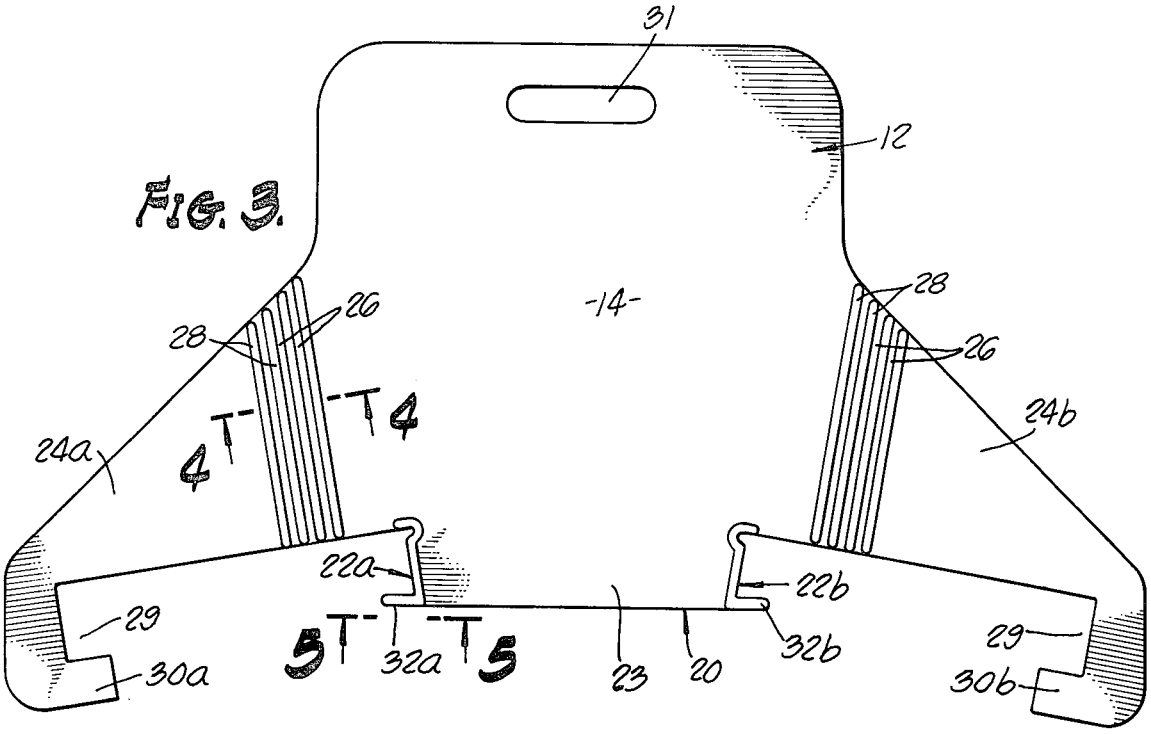
FIG. 3.
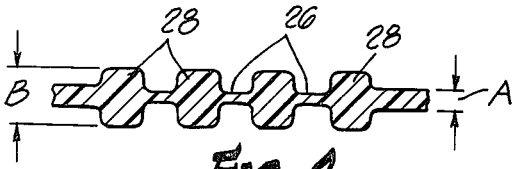
FIG. 4.
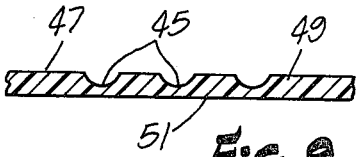
FIG. 9.
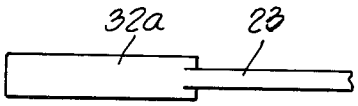
FIG. 5.
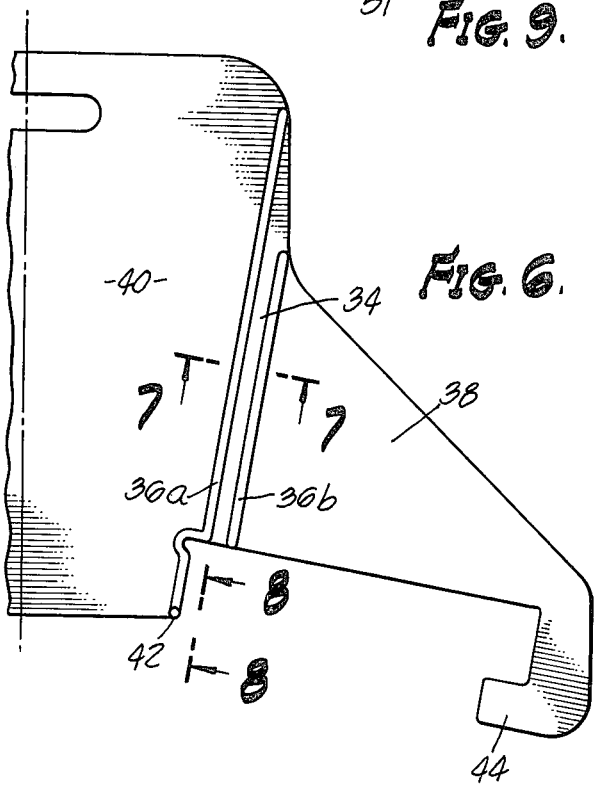
FIG. 6.
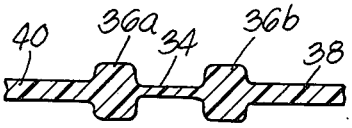
FIG. 7.
FIG. 8.
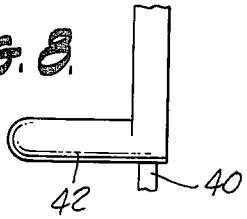

PORTABLE BACK REST

BACKGROUND OF THE INVENTION

1. Field of the Invention

The present invention relates to back rests and more particularly, to a lightweight, portable back rest of foldable construction which can be readily attached to a stadium bleacher seat or the like.

2. Discussion of the Prior Art

Many arenas or stadiums designed for spectator sports such as football, track, soccer, road racing, and the like, are provided with bleacher or plank-type seating. Such seating does not have back supports and is extremely uncomfortable, particularly for sports of long duration such as football and road racing. Consequently, many attempts have been made in the past to design portable back rests which may be carried by the spectator to the stadium and clamped or otherwise affixed to the bleacher seats and the prior art is replete with back rests of various configurations.

Perhaps the most common type of prior art back rest comprises a foldable metal framework upon which is mounted a back support member and a seat cushion. Gripping members in the form of adjustable clamps or gripping prongs are usually provided to affix the seat back to the forward edges of the bleacher seat. Generally, prior art back rests of this design were heavy, bulky, awkward to transport, and frequently difficult to affix securely and safely to the bleacher seat. Moreover, because of their rigid construction, they were often quite uncomfortable, having planar, upright backs which would not conform to or adequately support the back of the user. Also, because of the rather complicated construction of this class of back rest, they were often difficult and expensive to manufacture.

Exemplary of prior art seat backs of the aforementioned character are those described in the following U.S. Letters Patents:

| | |
|---|---|
| 2,092,666 - Dietrich | 466,873 - Hardendorf |
| 2,466,361 - Bjornskaas | 2,425,884 - Janssen |

Other types of seat backs of rigid or semirigid construction known to applicant include those described in the following U.S. Letters Patents:

| | |
|---|---|
| 3,359,036 | Druth, et al. |
| 1,780,570 | Stephens |
| 2,710,646 | Kirby |

A significantly improved seat back construction, of which the present invention is an improvement, is described in application Ser. No. 569,203, filed by James E. Pierce. The Pierce seat back is constructed of a single sheet of flexible material and may be flexed from its flat transport and storage condition to its operative condition for combination with a bleacher seat.

As will become apparent from the discussion which follows, the seat back of the present invention is superior in numerous respects to each of the various prior art structures previously identified. It is lightweight, extremely compact in its transport condition, and can readily be affixed to a bleacher seat without the use of tools and without the necessity for manipulation of screws, clamps, or other mechanical fasteners. Because it is formed of a unitary piece of flexible material, it is quite inexpensive to manufacture and is extremely durable. Additionally, because of its unique design, the seat back of the present invention is very comfortable in use and is highly safe and stable in its operative configuration. The safety and comfort of the seat back is enhanced by the unique locking means of the unit which permits it to tilt rearwardly so as to provide greater comfort and, at the same time, securely lock against bleacher seats of varying thickness.

SUMMARY OF THE INVENTION

It is an object of the present invention to provide a lightweight, easily portable back rest affording maximum comfort and support to the user when used in combination with a bleacher or similar backless seat.

It is another object to provide a back rest of the aforementioned character which may be conveniently and easily folded from an operative to a highly compact transport configuration.

It is another object of the invention to provide a back rest of the class described which may be constructed from a single piece of yieldably resilient material.

It is a further object to provide a back rest which can be quickly and easily detachably affixed to a bleacher seat without the necessity of manipulation of mechanical clamps, screws, or similar fasteners.

It is still another object of the invention to provide a back rest which is extremely stable and safe to use.

Another object of the invention is to provide a one-piece back rest formed of flexible material having a back panel and a pair of side panels hingeably connected thereto by a novel hinge means comprising a plurality of stria formed in the material intermediate the back panel and each of the side panels.

Still another object of the invention is to provide a back rest of the type described in the previous paragraph in which the side panels can be conveniently interlocked together when the back rest is in a transport configuration so as to hold them proximate the back panel and in a substantially coplanar relationship.

It is a further object to provide a back rest of the type previously described which is durable and resistant to weathering but, at the same time, is simple and inexpensive to manufacture.

In summary, these and other objects of the invention are achieved by a foldable back rest adapted to be releasably locked on a bleacher seat comprising a back panel formed of a resilient flexible material, the back panel being substantially planar in its transport configuration and being bendable into an operative back supporting configuration; a first bleacher seat gripping mechanism for releasably gripping the rearward edge portions of the bleacher seat when the back panel is in its operative configuration, the first gripping mechanism comprising at least two gripping or hook-shaped members formed integrally with the back panel and depending downwardly therefrom; a pair of side panels formed of a resilient flexible material hingeably interconnected to the back panel, the side panels being movable from a transport configuration wherein they are disposed in planes substantially parallel to the plane of the back panel to an operative configuration wherein they are disposed in planes forming an angle relative to the back panel; and second bleacher seat gripping mechanism integrally formed on each of the side panels for releasably gripping the forward edge portions of the bleacher seat when the side panels are in operative configuration.

BRIEF DESCRIPTION OF THE DRAWINGS

FIG. 2 is perspective view of the back rest of FIG. 1 showing its appearance when detachably affixed to a bleacher seat or the like.

FIG. 3 is a front view of the back rest as it appears in an unfolded substantially planar configuration.

FIG. 4 is a view taken along lines 4—4 of FIG. 3

FIG. 5 is a view taken along lines 5—5 of FIG. 3.

FIG. 6 is a view similar to FIG. 3, but showing only one side of another embodiment of the back rest of the invention having a different hinge arrangement and a different type of bleacher seat gripping means.

FIG. 7 is a view taken along lines 7—7 of FIG. 6.

FIG. 8 is a view taken along lines 8—8 of FIG. 6.

FIG. 9 is a view similar to FIG. 7 showing yet another form of hinge arrangement.

DESCRIPTION OF THE PREFERRED EMBODIMENT

Figure 1:
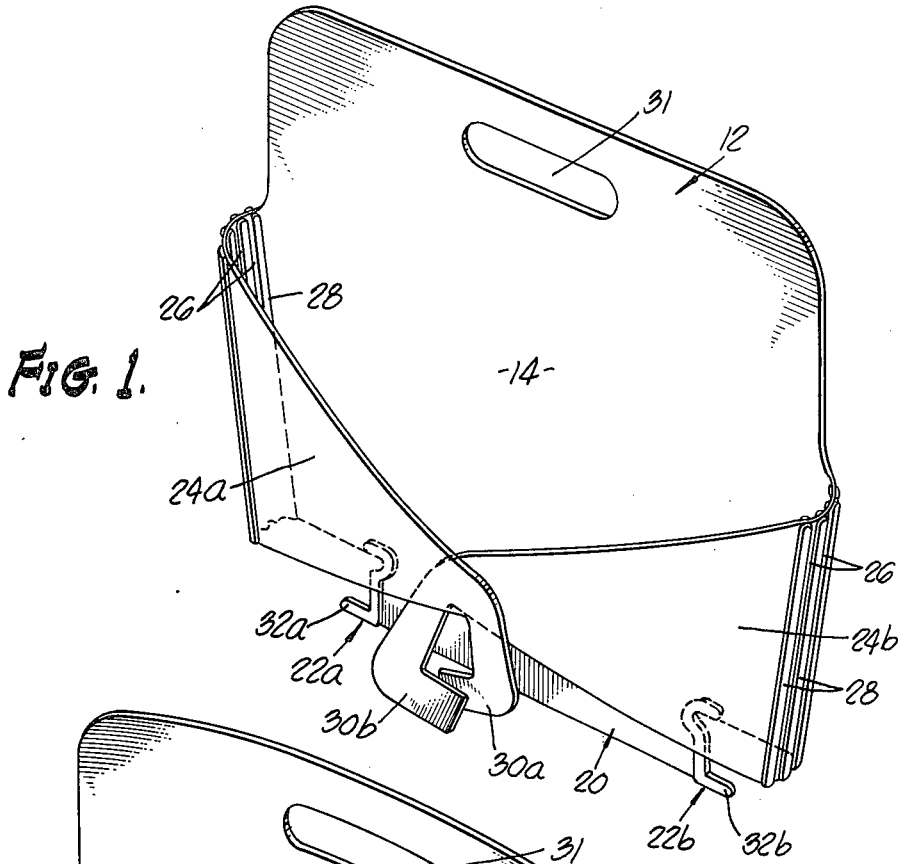
FIG. 1 is a front perspective view of one form of the back rest of the present invention illustrating its appearance in a folded storage or transport configuration.
Figure 2:
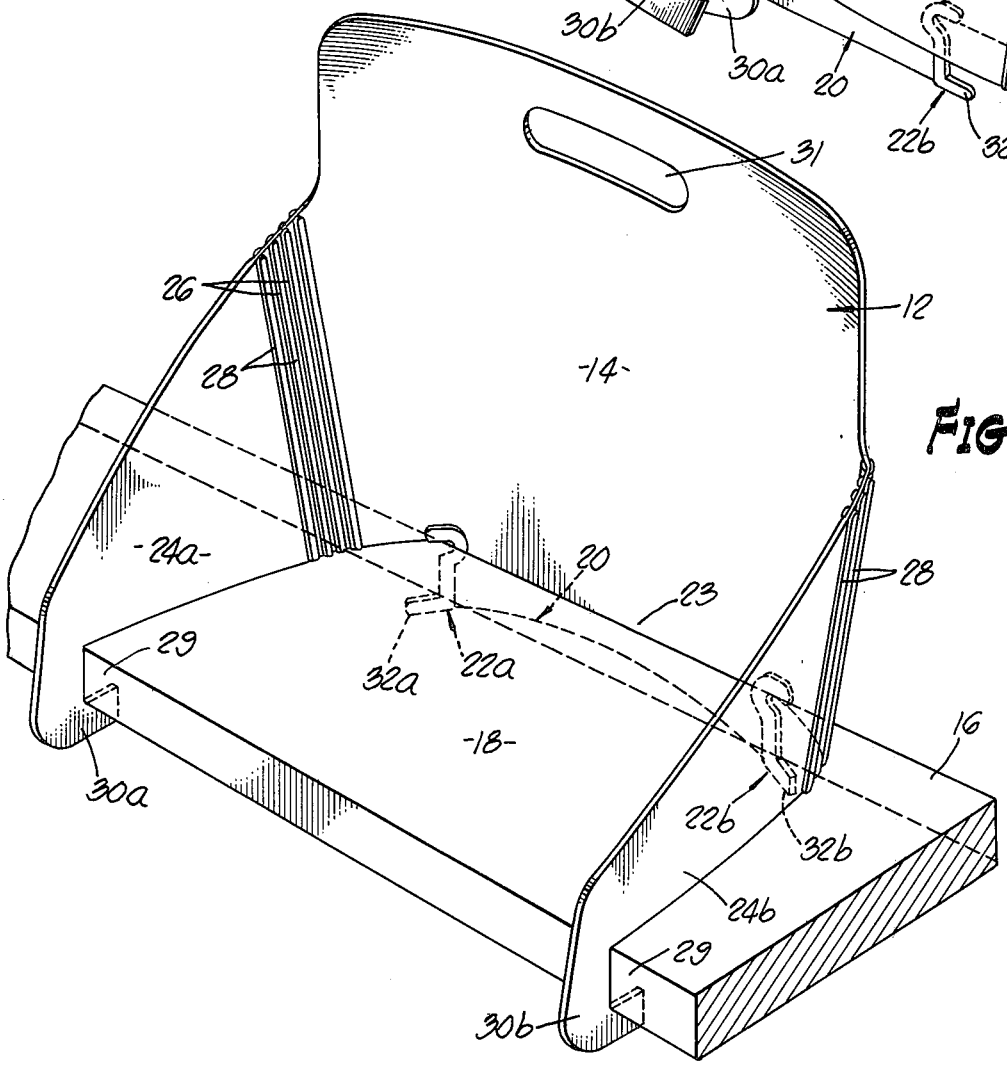

Referring to the drawings and particularly to FIGS. 1 and 2, one embodiment of the one-piece foldable back rest of the present invention is generally identified by the numeral 12. Back rest 12 comprises a back panel 14 formed of a resilient flexible material such as polyethylene, thin sheet metal, or other suitable composite material such as impregnated papers and the like. As illustrated in FIG. 1, the back panel 14 of the invention is substantially planar when the back rest is in its transport or storage configuration. When the back rest is in its operative position, as shown in FIG. 2, back panel 14 is bendable into a curved back supporting configuration.

First bleacher seat gripping means for releasably gripping the rearward edge portions 16 of a bleacher seat 18 (FIG. 2) are generally designated in the drawings by the numeral 20. In the form of the invention shown in FIGS. 1 through 5, a first gripping means, generally indicated by the numeral 20, comprises at least two hook-shaped members 22*a* and 22*b* formed integrally with back panel 14 and depending downwardly therefrom. As illustrated in FIG. 1, when the back rest is in its transport configuration, hook-shaped members 22*a* and 22*b* are disposed substantially in the plane of the back panel. This construction has the advantage that during transport of the back rest, the hook-shaped members being in the plane of the back panel will not inadvertently hook onto or engage another person's clothing, or other objects, during transport of the back rest. As best seen in FIGS. 3 and 5, the first bleacher seat gripping means of the invention also comprises a depending tail piece section 23 which is integral with and depends from back panel 14. Tail piece 23 is of the same wall thickness as back panel 14, but is of lesser width. As illustrated in FIG. 2, tail piece 23 extends below the top surface of bleacher seat 16 when the back rest is in its operative configuration.

Also comprising a part of the back rest of the invention are a pair of side panels 24*a* and 24*b* formed of the same resilient flexible material as back panel 14. Each side panel is hingeably interconnected to back panel 14 by unique hinge means presently to be described. The hinge means enables the side panels to be swingably moved from the transport configuration of FIG. 1, wherein they are disposed in planes substantially parallel to the plane of back panel 14, to the operative configuration of FIG. 2 wherein they are disposed in planes forming an angle relative to the back panel.

Referring to FIGS. 3 and 4, the hinge means of the embodiment of the invention there illustrated comprises a plurality of stria 26 formed in the flexible material intermediate each of the side panels 24*a* and 24*b* and the back panel 14. Provided along the margins of each of the stria of the hinge means are rib sections 28. Rib sections 28 have a wall thickness "B" which is approximately twice the wall thickness "A" of back panel 14. Ribs 28 serve to strengthen the hinge means and impart vertical rigidity thereto.

Also forming an important part of the back rest of the present invention are second gripping means 29 provided at the free extremities of side panels 24*a* and 24*b*. As best seen in FIG. 2, the second bleacher seat gripping means of this form of the invention comprises hook-shaped members 30*a* and 30*b* so constructed and arranged to embrace the front edge and undersurface of the bleacher seat 18. Turning to FIG. 1, it can be seen that hook members 30*a* and 30*b* also perform the function of interlocking the side panels together when the back rest is in its transport configuration. In this manner, the side panels 24*a* and 24*b* are held in essentially a coplanar relationship with respect to one another and in a spaced parallel relationship with respect to back panel 14. With the construction of the back rest of the invention as previously described, the back rest can be formed by conventional stamping or molding techniques from a single piece of material, such as polyethylene, or similar moldable plastics or other synthetic materials. It is significant to note that the construction of the back rest is such that when it is in a flat configuration, as illustrated in FIG. 3, the back panel and the first and second bleacher seat gripping means are all within the planes of the front and rear surfaces of the back and side panels.

OPERATION

During storage or transport of the back rest to and from the stadium or other arena, the back rest is locked into its transport configuration as illustrated in FIG. 1. In this configuration, the back rest is quite compact, has no outwardly protruding elements, and can be easily carried by the user by means of the finger receiving apertures 31 formed in the back panel.

Upon reaching the section of the bleacher seat upon which it is desired to detachably affix the back rest, hook members 30*a* and 30*b* are disengaged so that the side panels 24*a* and 24*b* can be swung forwardly about the hinge means. With the side panels extending forwardly in the manner illustrated in FIG. 2, locking hooks 30*a* and 30*b* are hooked over the forward edge of the bleacher seat as shown. Next, the user grasps back panel 14 at its sides and bends or shapes the back panel into the position illustrated in FIG. 2 so that tail piece 23 is disposed adjacent the rear edge of the bleacher seat. This bending action causes fingers 32*a* and 32*b* of hook members 22*a* and 22*b* to move from the position shown in FIG. 1 wherein they are coplanar with back panel 14 into the position shown in FIG. 2 wherein they extend beneath the bottom surface of bleacher 16, thereby locking the back rest against upward movement thereof relative to the bleacher seat. As best seen in FIG. 5, fingers 32*a* and 32*b* are formed integrally with tail piece 23, but are of slightly increased wall thickness so as to impart strength thereto. When the back rest has been thus mounted onto the bleacher seat, it will remain firmly attached thereto until the side panel members are bent toward one another so as to disengage hook members 30*a* and 30*b* from locking engagement with the forward edge of the bleacher seat. Because of the angular relationship of the bottom edges of the side panels 24*a* and 24*b* with respect to back panel 14, as shown in FIG. 3, the unit will tilt back relative to the plane of the bleacher seat, thereby providing comfort to the user and encouraging secure locking contact between hooks 30*a* and 30*b* and the front edge of the bleacher seat.

In removing the unit from the bleacher seat, once the front hook members 30*a* and 30*b* have been disengaged, the back panel 14, along with rear hook members 22*a* and 22*b*, will, due to the resiliency of the material, return to a flat configuration. The back rest can then be lifted upwardly and side panels 24*a* and 24*b* swung toward one another to enable interlocking together of hooks 30*a* and 30*b*, thereby returning the back rest to the transport configuration of FIG. 1.

Referring to FIGS. 6, 7 and 8, there is illustrated another embodiment of the back rest of the invention. As best seen in FIG. 6, this form of the invention is basically similar to the form of the invention previously described, but embodies hinge means and first bleacher seat gripping means of a slightly different construction. Referring to FIG. 7, it can be seen that the hinge means of this form of the invention comprises a single stria or reduced thickness wall section 34 disposed intermediate a pair of ribs 36*a* and 36*b*. Ribs 36*a* and 36*b* have a wall thickness greater than the wall thickness of stria 34 and approximately twice the wall thickness of the side panels 38 and of the back panel 40. As shown in FIGS. 6 and 8, the first bleacher seat gripping means of this form of the invention comprises a pair of generally cylindrically shaped bleacher seat gripping fingers 42 which protrude forwardly from back panel 40 at substantially right angles. When the back rest is in operative position on the bleacher seat, fingers 42 protrude beneath the bleacher seat and cooperate with hook members 44 which comprise a part of the first bleacher seat gripping means of this embodiment of the invention. Hook members 44 are so constructed and arranged as to embrace the front edge and undersurface of the bleacher seat when the back rest is mounted on the bleacher seat. Operation of this embodiment of the invention is basically identical to that previously described in the section entitled "Operation".

Turning now to FIG. 9, there is illustrated still another embodiment of hinge means of the back rest of the invention. In this form of hinge means, a plurality of grooves or stria 45 are provided on the front or face of the device intermediate the back panel 47 and each of the side panels 49. In this embodiment, no reinforcing ribs are provided but rather, the stria or grooves 45 are formed in a section 51 which is intermediate of and has the same wall thickness as the back and side panels.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

We claim:

1. A one-piece foldable back rest adapted to be releasably locked on a bleacher seat, comprising:

a. a back panel formed of a resilient flexible polyethylene sheet material, said back panel being substantially planar in its transport configuration and capable of being flexed into an operative back supporting configuration;

b. first bleacher seat gripping means for releasably gripping the rearward edge and bottom surface portions of the bleacher seat when said back panel is in its operative configuration, said first gripping means comprising at least two hook-shaped members formed integrally with said back panel, depending downwardly therefrom and disposed in the plane of said back panel when the latter is in a transport configuration said hook-shaped members including outwardly extending fingers and being movable with said back panel and substantially immovable relative thereto, whereby when said back panel is flexed into an operative back supporting configuration, said fingers of said gripping means will move into engagement with the bottom surface of the bleacher seat;

c. a pair of side panels formed of a resilient flexible polyethylene sheet material hingeably interconnected to said back panel, said side panels being movable from a transport configuration wherein they are disposed in planes substantially parallel to the plane of said back panel to an operative configuration wherein they are disposed in planes forming an angle relative to said back panel, said side panels being swingably movable relative to said back panel about hinge means formed intermediate each of said side panels and said back panel, said hinge means comprising a plurality of stria formed in said flexible material intermediate said back panel and each of said side panels; and d. second bleacher seat gripping means integrally formed on each of said side panels for releasably gripping the forward edge portions of the bleacher seat when said side panels are in an operative configuration, said second bleacher seat gripping means comprising hook-shaped members formed at the free ends of said side panels and so constructed and arranged to embrace the front edge and undersurface of the bleacher seat, said members being movable with said side panels and substantially immovable relative thereto.

2. A foldable back rest as defined in claim 1 in which said back panel and said side panels are formed of a single piece of resilient flexible material, said stria being formed in said single piece of said flexible material so as to form said hinge means.

* * * * *